US009798346B2

(12) United States Patent
Utsunomiya

(10) Patent No.: US 9,798,346 B2
(45) Date of Patent: Oct. 24, 2017

(54) VOLTAGE REFERENCE CIRCUIT WITH REDUCED CURRENT CONSUMPTION

(71) Applicant: SII Semiconductor Corporation, Chiba-shi, Chiba (JP)

(72) Inventor: Fumiyasu Utsunomiya, Chiba (JP)

(73) Assignee: SII Semiconductor Corporation (JP)

( * ) Notice: Subject to any disclaimer, the term of this patent is extended or adjusted under 35 U.S.C. 154(b) by 0 days.

(21) Appl. No.: 15/057,506

(22) Filed: Mar. 1, 2016

(65) Prior Publication Data

US 2016/0259360 A1 Sep. 8, 2016

(30) Foreign Application Priority Data

Mar. 2, 2015 (JP) ..... 2015-040577

(51) Int. Cl.
*G05F 3/16* (2006.01)
*G05F 3/26* (2006.01)

(52) U.S. Cl.
CPC ..... *G05F 3/262* (2013.01); *G05F 3/16* (2013.01)

(58) Field of Classification Search
CPC ... G05F 3/16; G05F 3/242; G05F 3/26; G05F 3/262; G05F 1/462; G05F 1/465; G11C 5/147
See application file for complete search history.

(56) References Cited

U.S. PATENT DOCUMENTS 4,327,321 A * 4/1982 Suzuki ..... G05F 3/262 323/315
5,373,226 A * 12/1994 Kimura ..... G05F 3/245 323/313
6,160,393 A * 12/2000 Ahn ..... G05F 3/262 323/315
8,013,588 B2 9/2011 Imura
2010/0156386 A1* 6/2010 Imura ..... G05F 3/242 323/313
2010/0182852 A1* 7/2010 Joo ..... G11C 5/147 365/189.09
2013/0106394 A1* 5/2013 Kobayashi ..... G05F 3/242 323/314

FOREIGN PATENT DOCUMENTS

JP 06152272 A * 5/1994

* cited by examiner

*Primary Examiner* — Harry Behm
(74) *Attorney, Agent, or Firm* — Brinks Gilson & Lione

(57) ABSTRACT

Provided is a reference voltage circuit capable of outputting, with a low voltage and low current consumption, a voltage that is less liable to change due to a temperature change, and has a low GND terminal reference voltage. The reference voltage circuit includes a first NMOS transistor and a second NMOS transistor connected by a current mirror circuit, the first NMOS transistor having a gate and a drain connected to each other via a first resistor, the second NMOS transistor having a gate connected to the drain of the first NMOS transistor, and a source connected to a GND terminal via a second resistor, the second NMOS transistor having a threshold voltage lower than a threshold voltage of the first NMOS transistor, in which a reference voltage is output from the source of the second NMOS transistor.

1 Claim, 2 Drawing Sheets

VOLTAGE REFERENCE CIRCUIT WITH REDUCED CURRENT CONSUMPTION

RELATED APPLICATIONS

This application claims priority under 35 U.S.C. §119 to Japanese Patent Application No. 2015-040577 filed on Mar. 2, 2015, the entire content of which is hereby incorporated by reference.

BACKGROUND OF THE INVENTION

1. Field of the Invention

The present invention relates to a reference voltage circuit capable of outputting, with low current consumption, a voltage that is less liable to change due to a temperature change, and has an extremely low GND terminal reference voltage.

2. Description of the Related Art

FIG. 2 is a circuit diagram for illustrating a related-art reference voltage circuit. The related-art reference voltage circuit includes an NMOS transistor 102, an NMOS transistor 103, a PMOS transistor 106, a PMOS transistor 107, a PMOS transistor 201, a resistor 104, a resistor 202, and an output terminal 108. The NMOS transistor 102 has a gate and a drain connected to each other via the resistor 104, the drain being further connected to a gate of the NMOS transistor 103, the gate being further connected to a drain of the PMOS transistor 106. The NMOS transistor 103 has a drain connected to a drain and a gate of the PMOS transistor 107, a gate of the PMOS transistor 106, and a gate of the PMOS transistor 201, and a source connected to the GND terminal 101. The PMOS transistor 106 has a source connected to a power supply terminal 100. The PMOS transistor 107 has a source connected to the power supply terminal 100. The PMOS transistor 201 has a drain connected to the GND terminal 101 via the resistor 202 and to the output terminal 108, and a source connected to the power supply terminal 100. A positive voltage is supplied to the power supply terminal 100 from a power supply, and a negative voltage is supplied to the GND terminal 101 from the power supply. The NMOS transistor 102 has a threshold voltage higher than a threshold voltage of the NMOS transistor 103, and the resistor 104 has a resistance value higher than a resistance value of the resistor 202.

In the related-art reference voltage circuit having the above-mentioned configuration, a current flowing through the NMOS transistor 103, which has a low threshold voltage, is copied by a current mirror circuit formed of the PMOS transistor 107 and the PMOS transistor 106, and the copied current serves as a drain current of the PMOS transistor 106. The drain current of the PMOS transistor 106 flows through the NMOS transistor 102 having a normal threshold voltage via the resistor 104. Thus, when the NMOS transistor 103 and the NMOS transistor 102 have the same drive capability and both the NMOS transistors perform saturated operation, both the NMOS transistors have the same overdrive voltage. Thus, a voltage corresponding to a difference in threshold voltages between both the NMOS transistors is applied to the resistor 104. The voltage applied to the resistor 104 does not change depending on temperature because changes in threshold voltages of both the NMOS transistors due to a temperature change are approximately the same (for example, see Japanese Patent Application Laid-open No. 2010-152510). A circuit formed of the PMOS transistor 201 and the resistor 202 is an additional circuit configured to output a voltage based on the voltage applied to the resistor 104 to the output terminal 108 by the GND terminal reference. With this additional circuit, a current flowing through the resistor 104 is copied and the copied current serves as a drain current of the PMOS transistor 201, and hence a current having the same value as the current flowing through the resistor 104 flows through the resistor 202. Thus, the resistor 104 and the resistor 202 are formed of the same material, and the resistor 202 is set to have a resistance value that is a fraction of the resistance value of the resistor 104, thereby being capable of outputting a voltage that is a fraction of the voltage applied to the resistor 104, from the output terminal 108 by the GND terminal 101 reference voltage.

Further, a minimum operating voltage of the related-art reference voltage circuit having the above-mentioned configuration is a power supply voltage with which the NMOS transistor 103 or the PMOS transistor 106 can perform the saturated operation. That is, the minimum operating voltage is a higher one of a voltage obtained by adding the overdrive voltage of the NMOS transistor 103 to a voltage obtained by adding an absolute value of a threshold voltage of the PMOS transistor 107 and an overdrive voltage thereof, and a voltage obtained by adding an overdrive voltage of the PMOS transistor 106 to a voltage obtained by adding the threshold voltage of the NMOS transistor 102 and the overdrive voltage thereof. If the overdrive voltages are set to be values small enough to be ignored, the minimum operating voltage can be reduced to a higher one of the absolute value of the threshold voltage of the PMOS transistor 107 and the threshold voltage of the NMOS transistor 102.

As described above, the related-art reference voltage circuit is capable of outputting a voltage that is less liable to change due to a temperature change and operating at low voltage, but has a problem in that the reference voltage circuit requires an additional circuit when outputting a GND terminal reference, resulting in an increase in current consumption due the addition of the circuit.

SUMMARY OF THE INVENTION

In order to solve the related-art problem described above, a reference voltage circuit according to one embodiment of the present invention has the following configuration.

The reference voltage circuit includes a first NMOS transistor and a second NMOS transistor connected by a current mirror circuit, the first NMOS transistor having a gate and a drain connected to each other via a first resistor, the second NMOS transistor having a gate connected to the drain of the first NMOS transistor, and a source connected to a GND terminal via a second resistor, the second NMOS transistor having a threshold voltage lower than a threshold voltage of the first NMOS transistor, in which a reference voltage is output from the source of the second NMOS transistor.

According to the reference voltage circuit of the one embodiment of the present invention, an additional circuit necessary for outputting the GND terminal reference output voltage may be omitted, unlike the related-art reference voltage circuit. Thus, current consumption may be reduced more than the related-art reference voltage circuit due to the absence of the additional circuit.

Further, in a case where a voltage value of a reference voltage to be output is extremely low, a minimum operating voltage of the reference voltage circuit according to the one embodiment of the present invention is hardly increased from that of the related-art reference voltage circuit.

DETAILED DESCRIPTION OF THE PREFERRED EMBODIMENTS

Figure 1:
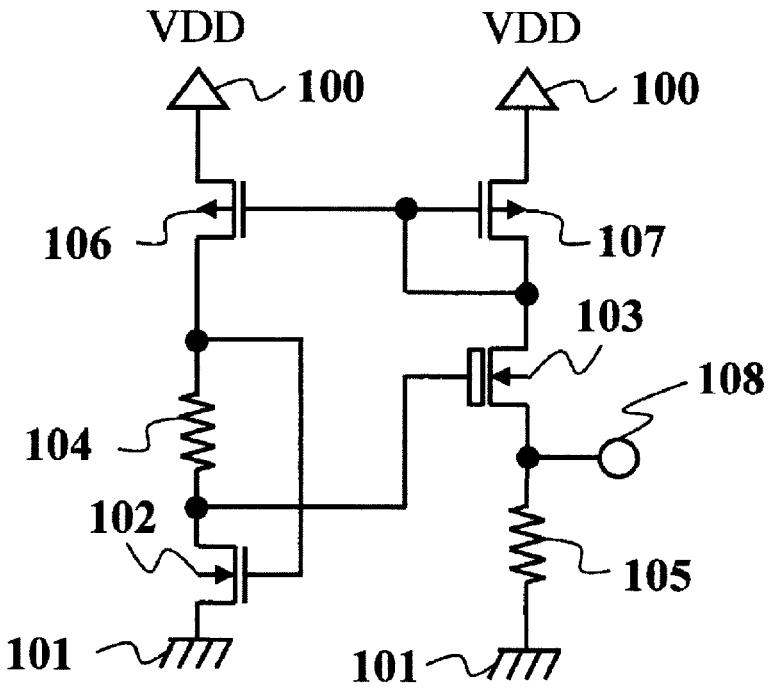
FIG. 1 is a circuit diagram for illustrating a reference voltage circuit according to an embodiment of the present invention.
Figure 2:
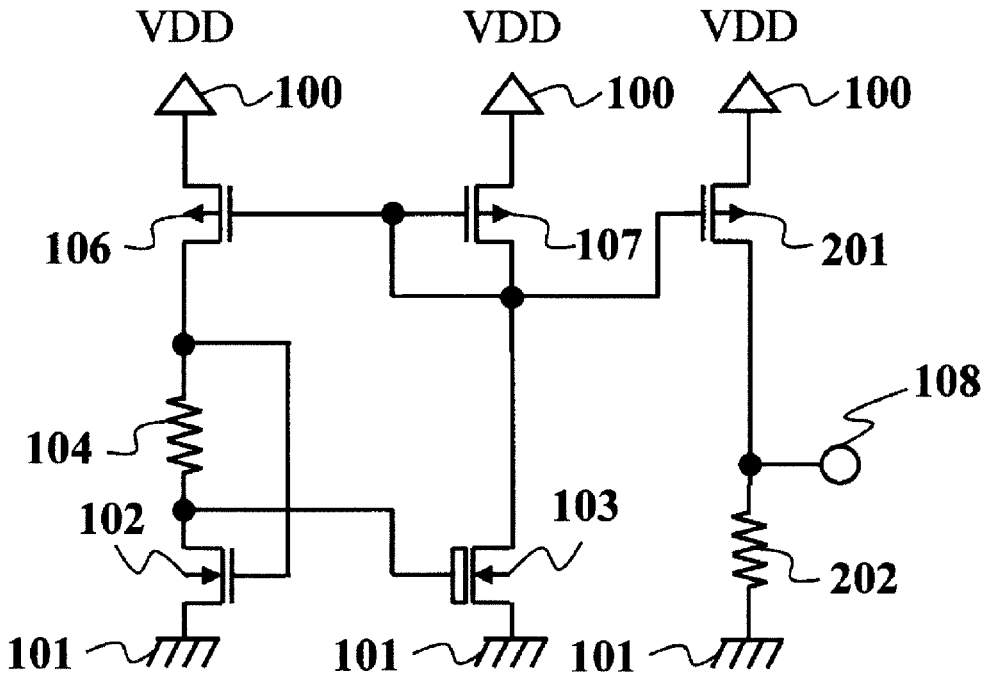
FIG. 2 PRIOR ART
FIG. 2 is a circuit diagram for illustrating a related-art reference voltage circuit.

FIG. 1 is a circuit diagram for illustrating a reference voltage circuit according to an embodiment of the present invention. The reference voltage circuit according to this embodiment includes an NMOS transistor 102, an NMOS transistor 103, a PMOS transistor 106, a PMOS transistor 107, a resistor 104, a resistor 105, and an output terminal 108.

The NMOS transistor 102 has a gate and a drain connected to each other via the resistor 104, the drain being further connected to a gate of the NMOS transistor 103, the gate being further connected to a drain of the PMOS transistor 106. The NMOS transistor 103 has a drain connected to a drain and a gate of the PMOS transistor 107 and to a gate of the PMOS transistor 106, and a source connected to the GND terminal 101 via the resistor 105. The PMOS transistor 106 has a source connected to a power supply terminal 100. The source of the NMOS transistor 103 is further connected to the output terminal 108 of the reference voltage circuit.

A positive voltage is supplied to the power supply terminal 100 from a power supply. A negative voltage is supplied to the GND terminal 101 from the power supply. The NMOS transistor 102 has a threshold voltage higher than a threshold voltage of the NMOS transistor 103, and the resistor 104 has a resistance value higher than a resistance value of the resistor 105. The PMOS transistor 107 and the PMOS transistor 106 form a current mirror circuit.

The reference voltage circuit of this embodiment having the above-mentioned configuration operates as follows to output a reference voltage.

A current flowing through the NMOS transistor 103, which has a low threshold voltage, is copied by the current mirror circuit, and the copied current serves as a drain current of the PMOS transistor 106. The drain current of the PMOS transistor 106 flows through the NMOS transistor 102 having a normal threshold voltage via the resistor 104. Thus, when the NMOS transistor 103 and the NMOS transistor 102 have the same drive capability and perform saturated operation, the NMOS transistors have the same overdrive voltage. Thus, a total value of voltages applied to the resistor 104 and the resistor 105 corresponds to a difference in threshold voltages between both the NMOS transistors. The voltage applied to the resistor 104 or the resistor 105 does not change depending on temperature because changes in threshold voltages of both the NMOS transistors due to a temperature change are approximately the same. Further, the resistor 104 and the resistor 105 are formed of the same material, and hence the voltage applied to the resistor 105 does not change depending on temperature. Thus, it is possible to output a reference voltage that is less liable to change due to a temperature change, from the output terminal 108 by the GND terminal 101 reference.

Further, the reference voltage circuit of this embodiment can output a low reference voltage when the resistance value of the resistor 105 is set to be smaller than the above-mentioned resistance value of the resistor 104. In addition, when a reference voltage to be output is extremely low, the minimum operating voltage of the reference voltage circuit of this embodiment is increased from the minimum operating voltage of the related-art reference voltage circuit only by this reference voltage. Thus, it is possible to output a reference voltage, which is less liable to change due to a temperature change, from a low power supply by the GND terminal reference.

As described above, in the reference voltage circuit of this embodiment, the additional circuit, which is required for the related-art reference voltage circuit in order to output the GND terminal reference voltage, may be omitted. Thus, current consumption can be reduced due to the absence of the additional circuit.

In addition, the minimum operating voltage of the reference voltage circuit of this embodiment has a value obtained by adding a reference voltage to be output to the minimum operating voltage of the related-art reference voltage circuit. Thus, the minimum operating voltage of the reference voltage circuit of this embodiment is hardly increased from the minimum operating voltage of the related-art reference voltage circuit when a reference voltage to be output is set to be a low value.

That is, the reference voltage circuit of this embodiment is capable of outputting a reference voltage that does not change depending on a temperature change, and has a low GND terminal reference voltage, with a low power supply voltage and low power consumption.

What is claimed is:

1. A reference voltage circuit, comprising:

a first NMOS transistor including a gate and a drain connected to each other via a first resistor, and a source connected to a GND terminal;

a second NMOS transistor that includes a source connected to the GND terminal via a second resistor, and a gate connected to the drain of the first NMOS transistor, and has a threshold voltage lower than a threshold voltage of the first NMOS transistor, wherein a total value of voltages applied to the first resistor and the second resistor corresponds to a difference in threshold voltages between the first and the second NMOS transistors;

a first PMOS transistor including a source connected to a power supply terminal, and a drain connected to the gate of the first NMOS transistor; and a second PMOS transistor including a source connected to the power supply terminal, and a drain and a gate connected to the gate of the first PMOS transistor and the drain of the second NMOS transistor, wherein a reference voltage is output from the source of the second NMOS transistor.

* * * * *